United States Patent [19]

Dornes

[11] Patent Number: 4,966,053

[45] Date of Patent: Oct. 30, 1990

[54] MUSIC SYNTHESIZER WITH MULTIPLE MOVABLE BARS

[76] Inventor: John Dornes, P.O. Box 1241, Pahoa, Hi. 96778

[21] Appl. No.: 326,460

[22] Filed: Mar. 20, 1989

Related U.S. Application Data

[63] Continuation of Ser. No. 66,504, Jun. 26, 1987, abandoned, which is a continuation of Ser. No. 2,223, Feb. 12, 1987, abandoned.

[51] Int. Cl.[5] ..... G10G 1/00; G10H 1/34

[52] U.S. Cl. ..... 84/718; 84/453; 84/477 R

[58] Field of Search ..... 84/1.18, 1.19, 1.24–1.27, 84/216, 245, 424, 425, 453, 477 R, 478, DIG. 4, DIG. 5, DIG. 16, DIG. 19, DIG. 26, 644, 670, 718–721

[56] References Cited

U.S. PATENT DOCUMENTS

| | | | |
|---|---|---|---|
| 2,201,232 | 5/1940 | Helberger | 84/1.27 |
| 2,969,704 | 1/1961 | Osborne et al. | 84/1.24 X |
| 3,227,027 | 1/1966 | Von Gunten | 84/1.24 X |
| 3,257,494 | 6/1966 | Starck | 84/1.27 X |
| 3,358,070 | 12/1967 | Young | 84/1.24 X |
| 3,562,399 | 2/1971 | Yamauchi | 84/1.18 X |
| 3,681,507 | 8/1972 | Slaats et al. | 84/1.27 X |
| 4,085,647 | 4/1978 | Adachi | 84/1.24 |
| 4,170,916 | 10/1979 | Fritz et al. | 84/1.24 |
| 4,305,321 | 12/1981 | Cohn | 84/1.24 |
| 4,794,838 | 1/1989 | Corrigan, III | 84/1.24 X |

*Primary Examiner*—Stanley J. Witkowski
*Attorney, Agent, or Firm*—Eric P. Schellin

[57] ABSTRACT

A variable control device accessory for a music synthesizer having a horizontally disposed keyboard. The device is positioned in front of the keyboard. It has a plurality of movable bars, at least of one of which is capable of being pivotally and slidably moved by the wrist of a player while all the others are only slidable. The bars modulate selected light beams focussed on light responsive mechanisms to produce variably dependent analog signals as inputs to the music synthesizer.

4 Claims, 12 Drawing Sheets

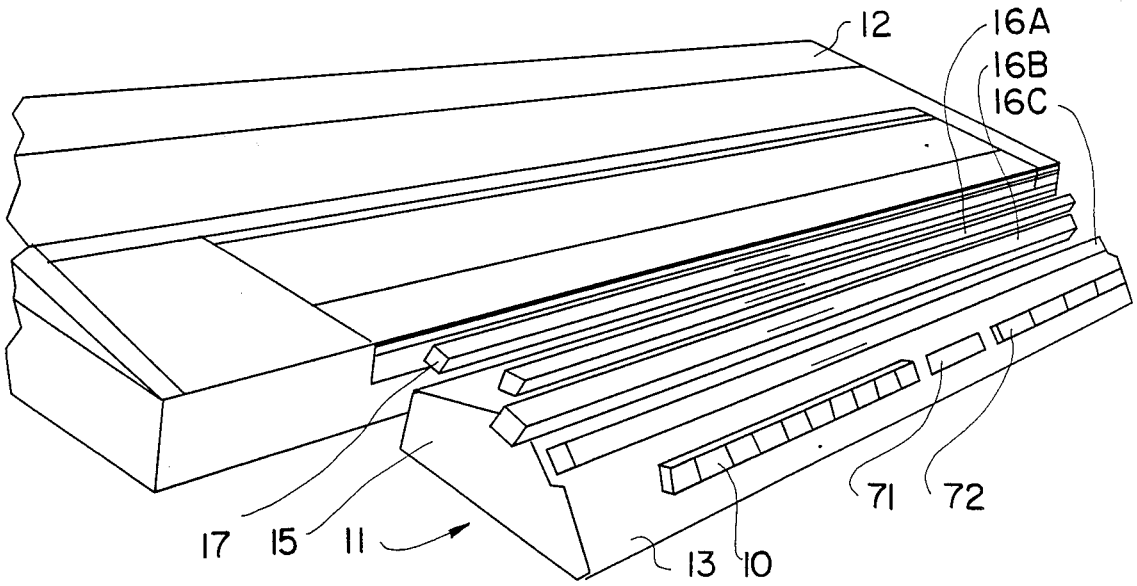
Fig. 1
Fig. 2
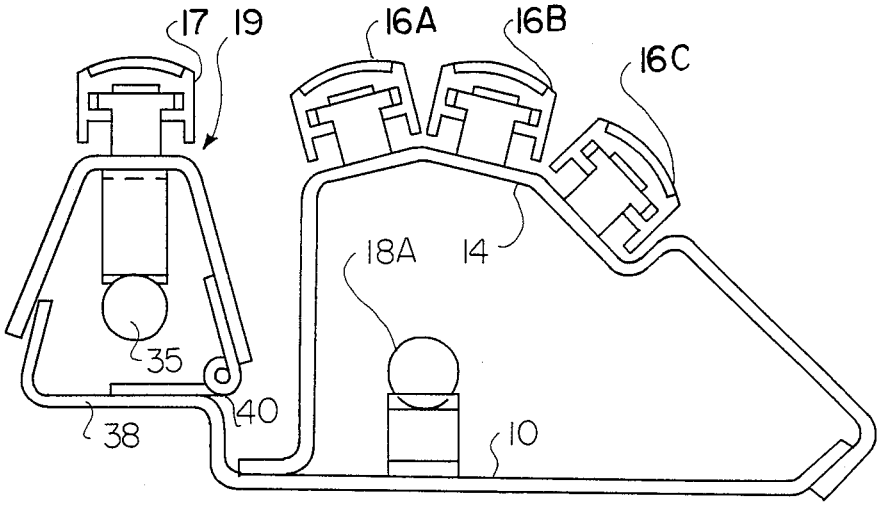

MUSIC SYNTHESIZER WITH MULTIPLE MOVABLE BARS

REFERENCE TO PRIOR APPLICATION

The present application is a continuation application of U.S. patent application Ser. No. 07/066,504, filed June 26, 1987 now abandoned, which is a continuation in part of U.S. patent application Ser. No. 07/002,223 filed Feb. 12, 1987, now abandoned.

BACKGROUND OF THE INVENTION

Electronic keyboards of music synthesizers are presently equipped with what are termed performance control devices usually in the form of wheels or levers at the left of the keyboard. They are able to alter various synthesizer functions such as pitch, blend and modulation.

Volume is usually variable in the form of a knob or sliding potentiometer. In addition, it is presently possible to actuate some of these functions by the use of foot pedals or breadth control when such are provided. The disadvantage of this is evident when it becomes necessary for the performer to remove one hand from the business of playing the keys to engage the pitch or modulation wheels and to operate one or the other as desired.

In some prior art devices, pedals are sometimes provided and employed for the many different functions to be dealt with, e.g., sustain, portaments, volume, modulation, and the like. In addition thereto foot switches may be provided to control effects, and the like, pitch change, drum machine, etc., that it can be confusing and difficult to achieve an expressive performance.

It is the intent of this invention to create a device capable of a plurality of different motions simultaneously or separately; each distinct motion capable of being assigned and transmitted electronically to various "performance parameters" and to other useful destinations. It is the object to achieve the above intent without the necessity of the performer removing either hand from the keys of the keyboard.

The device hereinafter disclosed comprises a framework upon which is articulated one or more movable components placed in such a way that can be easily controlled and moved by a portion of the wrist or flat of the hand at the same time as the fingers of the hand play the keys of the keyboard.

The object of the device of the present invention is to allow a keyboard performer to control, in real time and in a personally expressive manner, any individual or combination of sound modifying parameters without the necessity of either of the hands leaving the keyboard.

The device of the present invention is not constructed whereby any mechanical linkages are made with the music synthesizer, rather all of the connections are made electrically. Furthermore, the device has electronically driven software and hardware whereby memory is supplied to electronically repeat or re-call from memory the same functions and parameters as desired.

SUMMARY OF THE INVENTION

Apparatus created to accomplish the principle motions capable of the improved device comprises an elongated housing mounted at the front of a music synthesizer between the keys of the music synthesizer and the performer.

The device consists of a main housing which may be supported independently of the music synthesizer apparatus or may be attached to the music synthesizer by brackets and the like. The device also has a pivotal portion located between the main housing and the keys of the music synthesizer. The pivotal device supplies two parameters, i.e. analogue voltage output variable by the degree of arcuate motion and by side to side motion of a slidable bar.

The main housing has three slidable bars that provide for to and fro movement of the bar to thereby also produce variable analogue voltage output which may be digitized.

Both the first bar and the other bars are parallel and mounted close together and as said, proximate to the keys. They are adapted and constructed to be moved by a portion of the hand between fingers and lower arm. These motions, separately or together, and in a wide variety of complex and simple patterns, are capable of altering or modifying the sound parameters of the music synthesizer. Examples: pitch, volume and modulation are easily modified with either hand from any point on the keyboard with a back and forth wrist movement which, in contact with the bar, could elicit vibration in much the same manner as a cellist or violinist. Sound volume levels could appropriately be increased or diminished expressly at will. It is also possible to configure the bars to permit a cross fade between two different sound sources (i.e. Sound A would slowly fade while mixing gradually with Sound B until only B is heard). This is also useful for mixing and varying other special effects such as phasing, flanging, echo, delay, and the like.

BRIEF DESCRIPTION OF THE DRAWINGS

FIG. 1 is a perspective view of the instant invention mounted before the keyboard of a music synthesizer;

FIG. 2 is a side view of the said device with the end plates removed;

FIG. 6 is an exploded view of a slide bar showing the components thereto, some in fragmentary form;

DETAILED DESCRIPTION OF THE INVENTION

Figure 5:
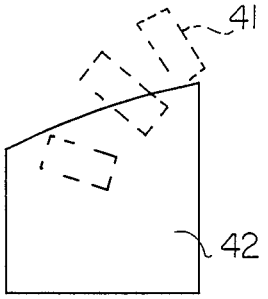
FIG. 5 is a diagrammatic view of progressive light distribution onto a photocell of FIGS. 3 and 4.

The device of the present invention is designated by reference numeral 11. It is pointed out that the device is arranged in front of a music synthesizer 12 which may be of any make. The device 11 may be supported on its own stand (not shown) or may be affixed to the music synthesizer by suitable means (not shown).

The device includes a housing 13 having a relatively flat bottom 10 and a downwardly sloping top 14. The ends are enclosed by side walls 15.

From FIG. 2, especially, it will be seen that there are three elongated slide bars 16A, 16B and 16C mounted on top of the housing. To the rear of the housing 13 there is located another elongated bar 17 for slide and arcuate movements, i.e. between the said housing 13 and the front of the music synthesizer 12.

Bars 16A, 16B and 16C are slidably mounted for independent movement back and forth from right to left or from left to right.

Likewise bar 17 on auxiliary housing 19 is mounted for similar side to side movement plus arcuate motion. It should also be noted that the housing 13 has mounted at the bottom thereof two electric lamps 18A and 18B in a row. The auxiliary housing 19 three lamps 35 mounted therein.

Attention is now directed to FIG. 6 for a detailed consideration of the manner in which the slidable bars are adapted and constructed for the purpose intended. Lamps 18A and 18B are mounted as mentioned in the immediate foregoing in regard to one bar, but the following pertains to the other two bars as well that move only from side to side. The bar includes an elongated inverted U-shaped element 21. It rides on a T-shaped block 22 one side 23 of which acts as a block to an override. Internally of the bar are guides 24 and 25. The bar has an elongated window 26 to which is affixed a transparent or translucent light length carrying block 27 is mounted. Lamp 18A, mentioned in the above, is mounted below a slot 28 in the upper portion 14 of the housing whereby light may pass through the housing, through said light carrying block 27 to provide a positioning feature. The bar has mounted at the underside thereof two bored spacing cylinders 30 to which an elongated horizontally disposed wedge-shaped mask 31 is positioned. Positioned above the mask is a phototransistor 32 or other photocell mounted on a horizontally disposed support 29 cantilever supported at the end opposite to the photocell 32 by a block 33 which is bolted to the upper portion of the housing. The upper portion 14 of the housing also has a hole 34 and an electric lamp 18B thereinunder. The hole 34 is in alignment with the photocell 32. In use with the bar in a central portion, the mask 31 covers one half of the active area of the photocell 32 as it is interposed between the light source 18B and the photoelectric cell 32. When the bar is moved to the right the mask 31 obfuscates more of the photocell 32. On the other hand as the bar is moved to the left more of the light from the lamp 18B is permitted to impinge on the photocell 32 providing thereby an increase in voltage.

The bar 17 is fitted with an upper cover 34A having its hand or finger engaging surface with a charactistic increasing friction, and for increasing the esthetics of the bar. All three bars 16A, 16B and 16C are constructed essentially similarly, except that the light from lamps 18A and 18B are used for all three bars as can be seen in FIG. 2.

Figure 4:
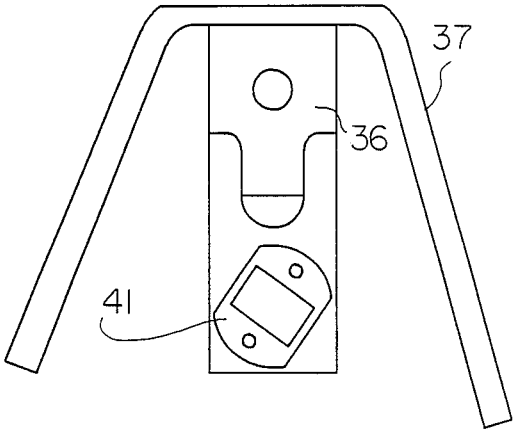
FIG. 4 is an enlarged view of a portion of FIG. 3.

Turning now to FIGS. 2 and 4 showing the auxiliary housing 19 which has bar 17, the actual bar itself is constructed in the same manner as the super-structure for bars 16A, 16B and 16C. However the sub-structure is different because it has an additional position as a result of its being able to move arcuately and not just in a side to side manner.

As the auxiliary housing 19 does not have access to the light emanating from lamps 18A and 18B, it has its own lamps for the same purpose and positioning. It has in addition thereto a third lamp 35 mounted on a leg of U-shaped bracket 36. The bracket 36 is mounted to the underside of the top portion 37 of the auxiliary housing 19. The top portion of the auxiliary housing 19 has an elongated and inverted U-shaped configuration. The bar 17 is mounted externally of the top portion 37. The bottom 38 is merely a raised extension of the flat bottom 10. The top portion 37 is hingedly connected to the bottom 38 as by hinge 40.

Figure 3:
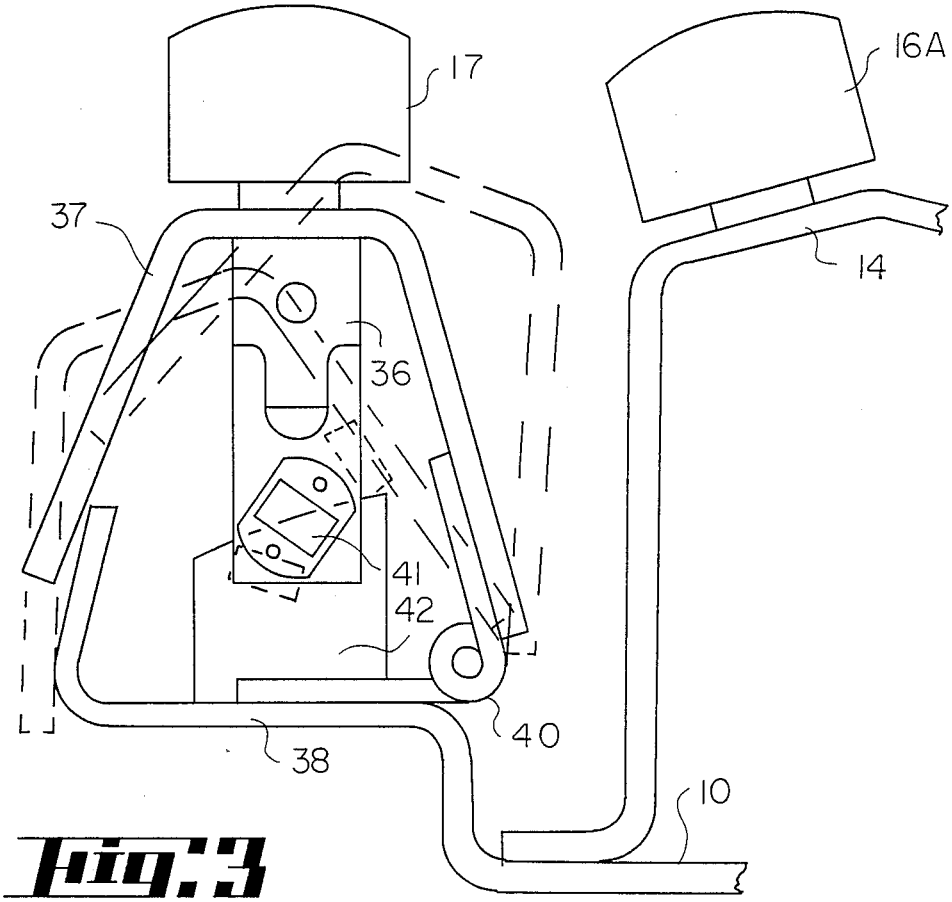
FIG. 3 is an enlarged end view of the pivotal bar.
Figure 4:
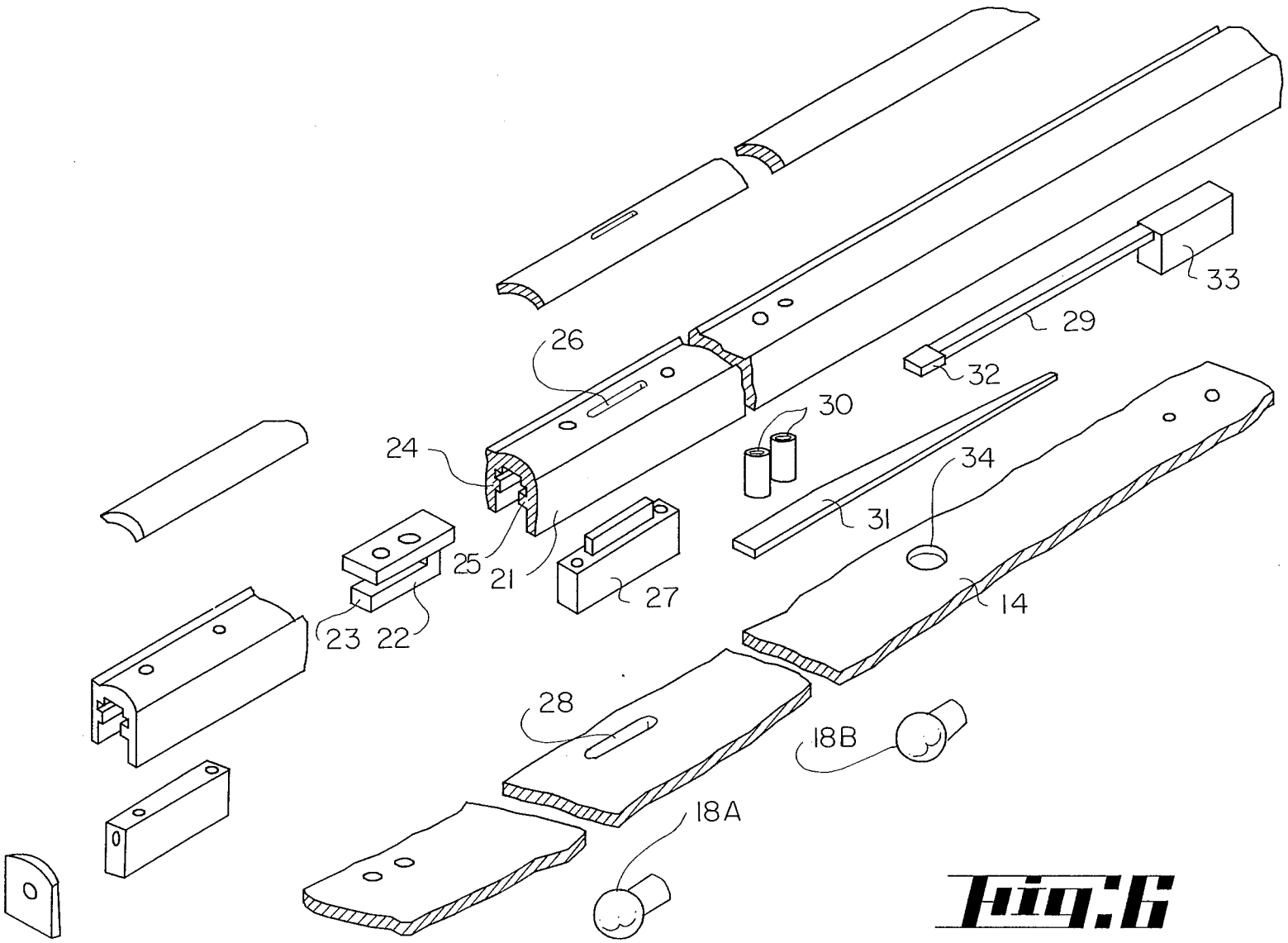
Figure 7:
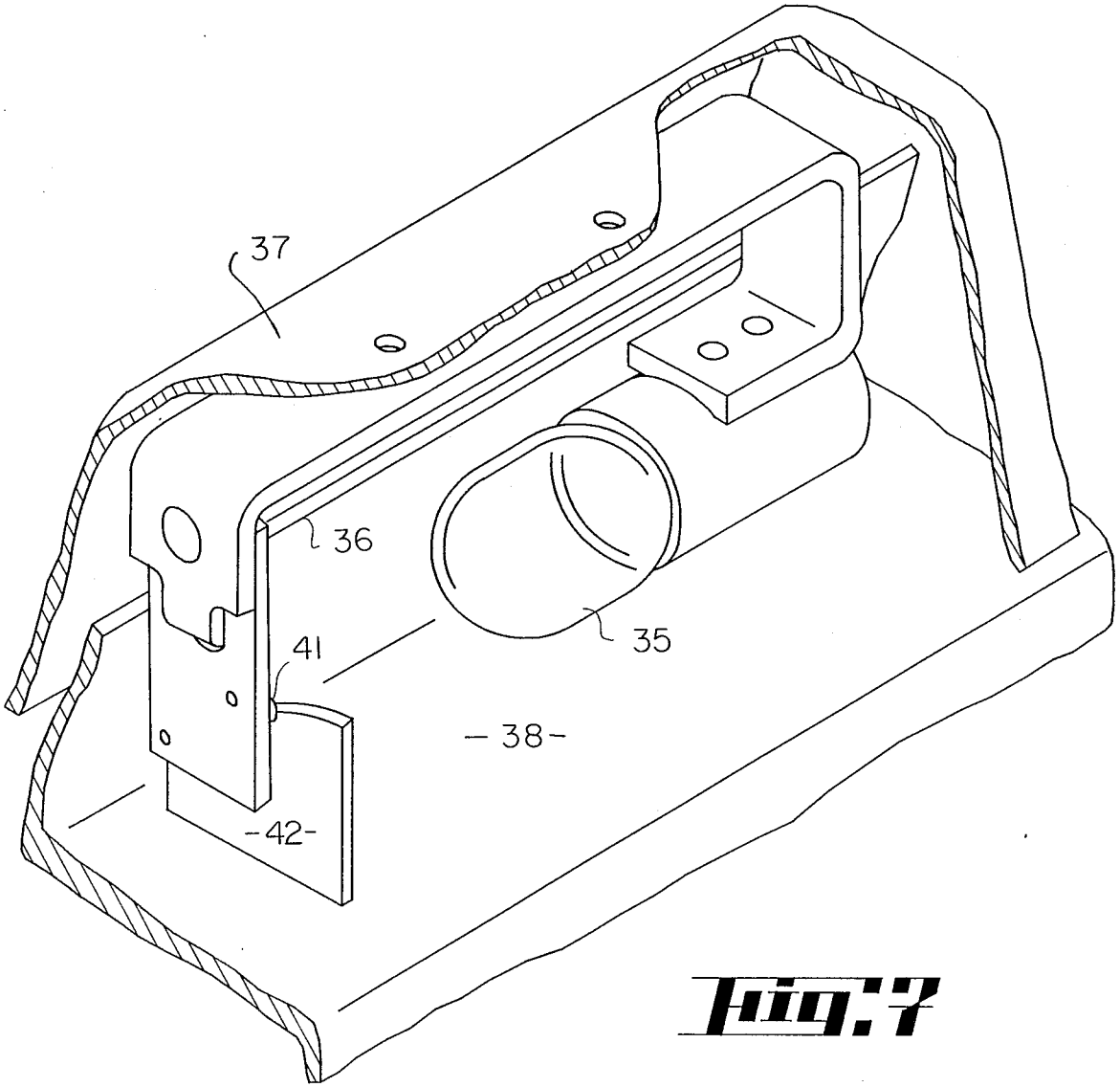
FIG. 7 is an enlarged perspective view of the lamp and photocell arrangement for the first bar.

The bracket 36 also has mounted at the appropriate leg a photocell 41. An arcuate mask 42 is mounted vertically on bottom 38 and is interposed between the light of lamp. The light falling on the photocell 41 varies in accordance with the movement of the top portion 37 of the auxiliary housing as can be seen form the ghost lines of FIGS. 3 and especially FIG. 5, where the photocell 41 moves past mask 42 to form zero light impingement to full impingement.

Figure 8:
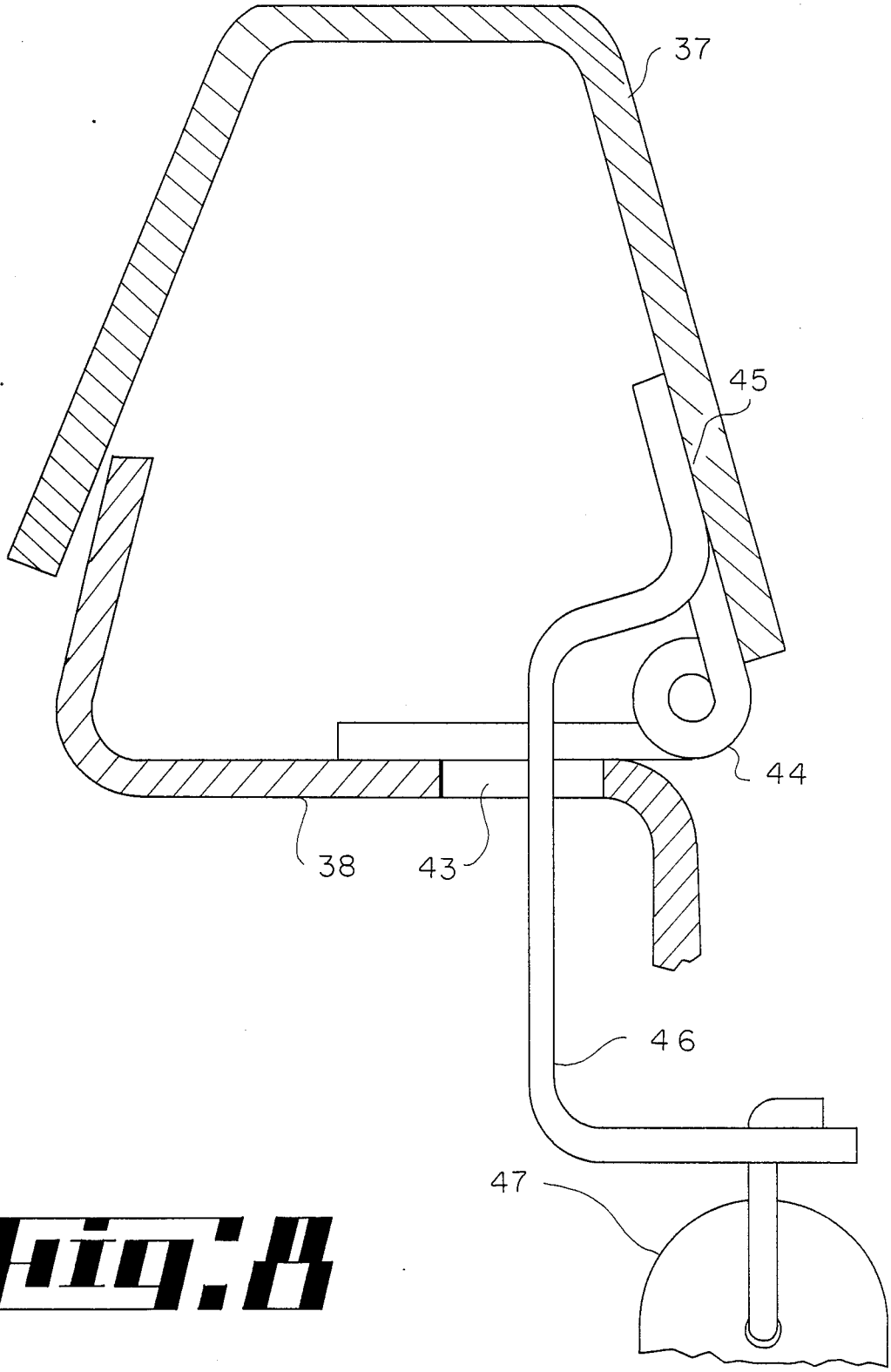
FIG. 8 is a view of the counter balancing means for the auxiliary housing.
Figure 9A:
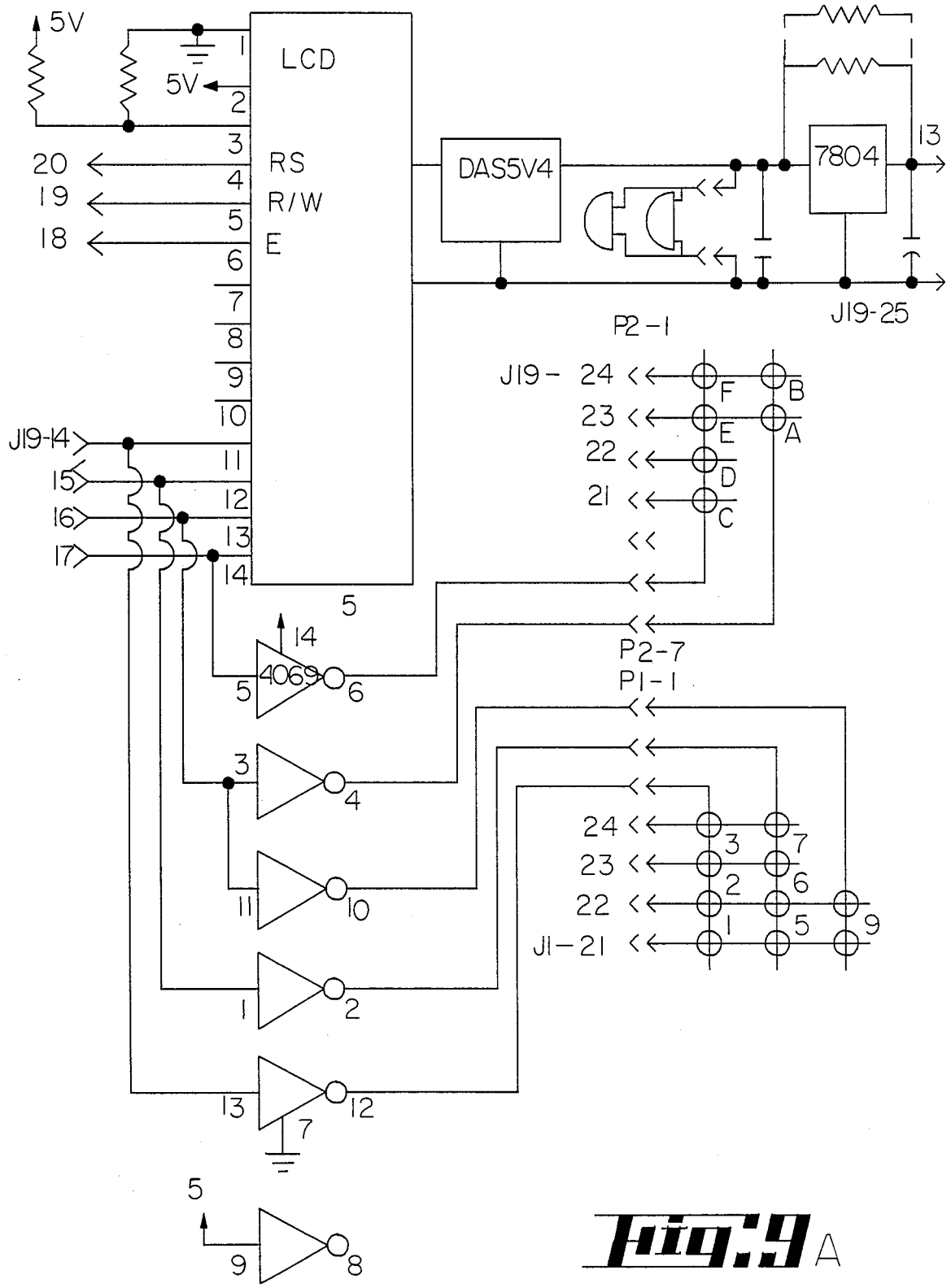
FIGS. 9A and 9B is a schematic of the electric circuitry for the device of the present invention itself.
Figure 9B:
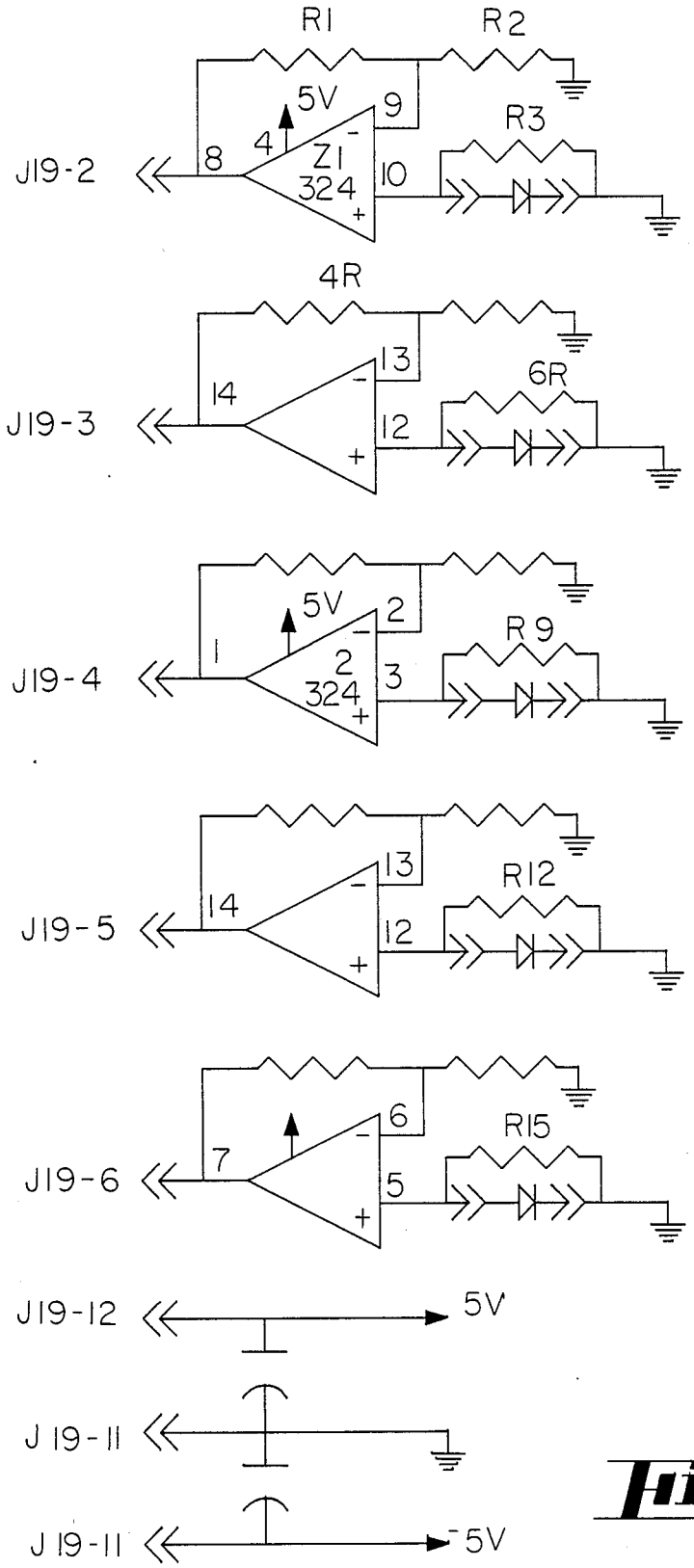
Figure 10A:
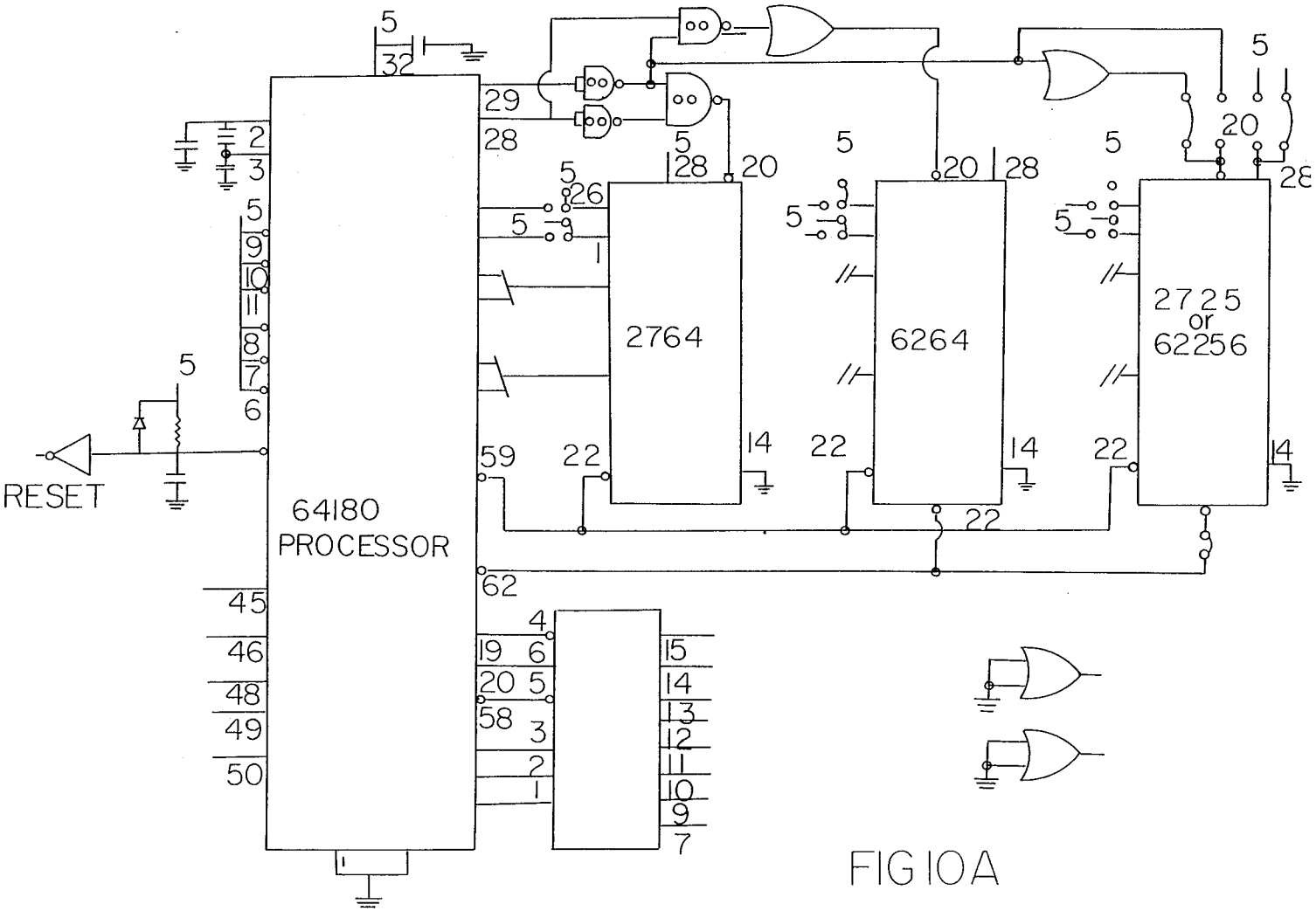
FIGS. 10A, 10B, 10C, 10D and 10E pertain to a schematic of the electronic circuitry for imparting input to the music synthesizer.
Figure 10B:
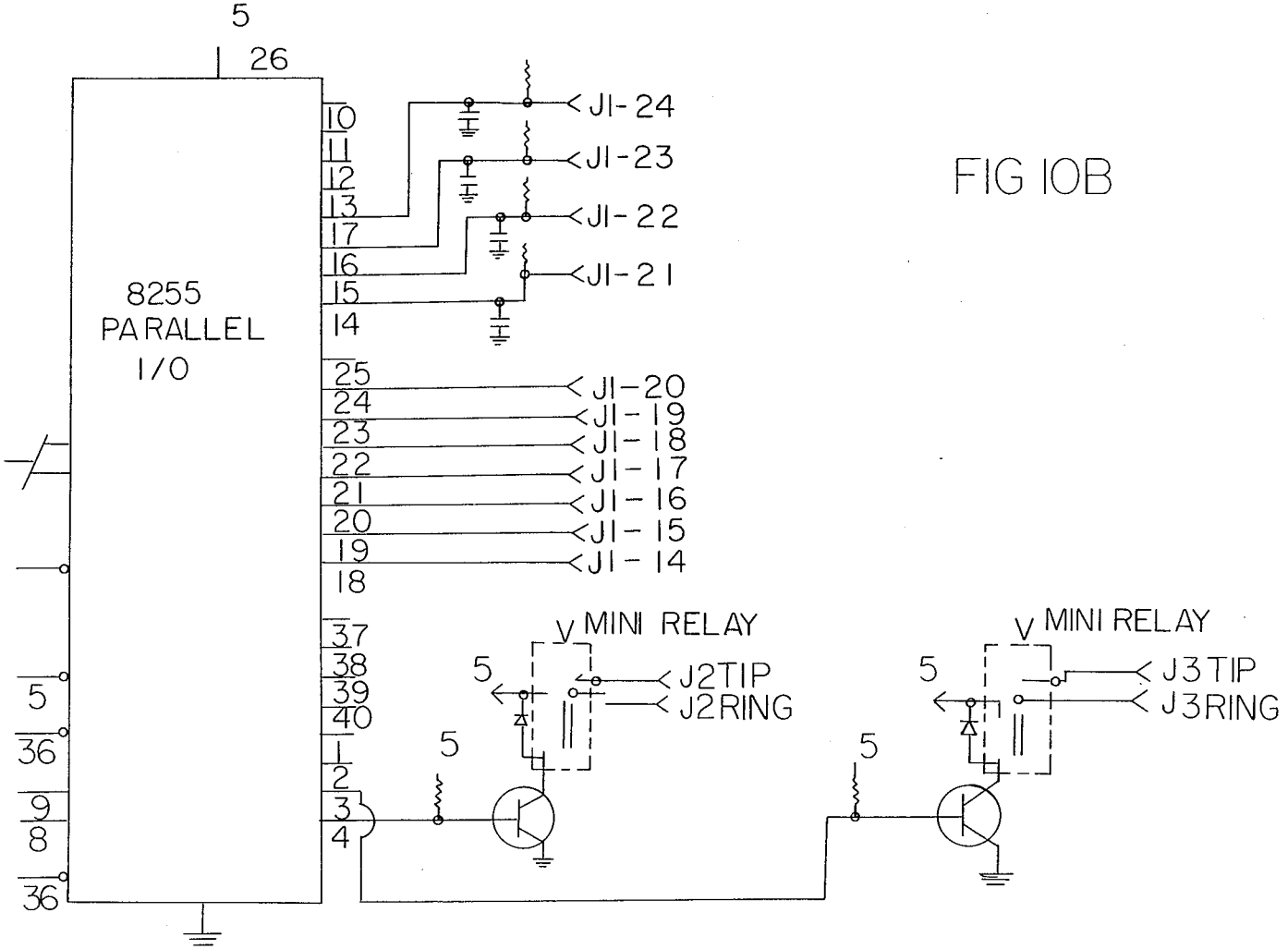
Figure 10C:
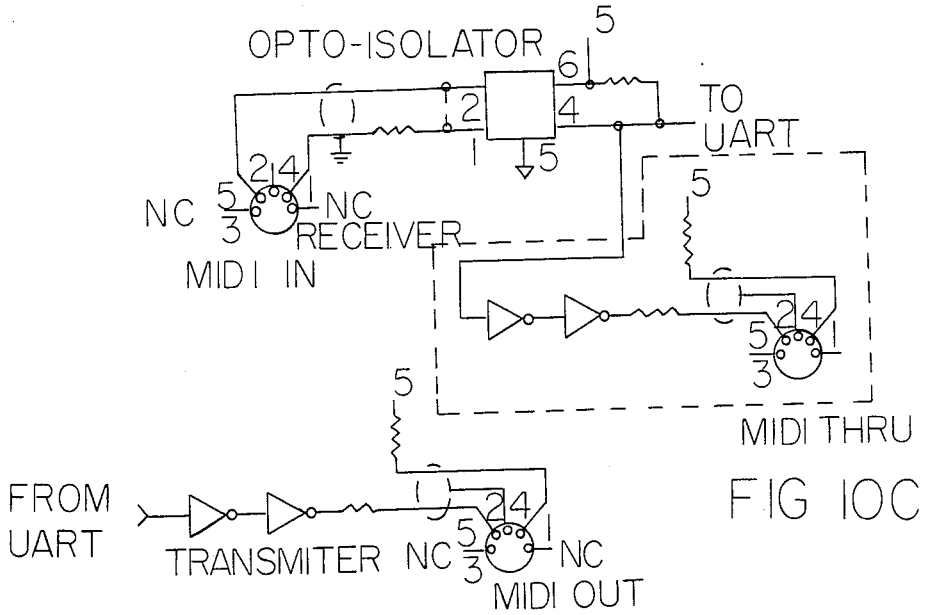
Figure 10E:
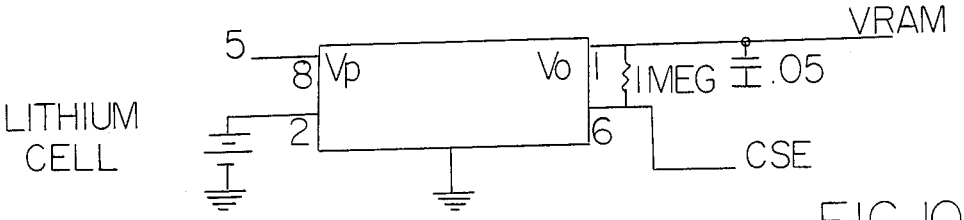
Figure 10D:
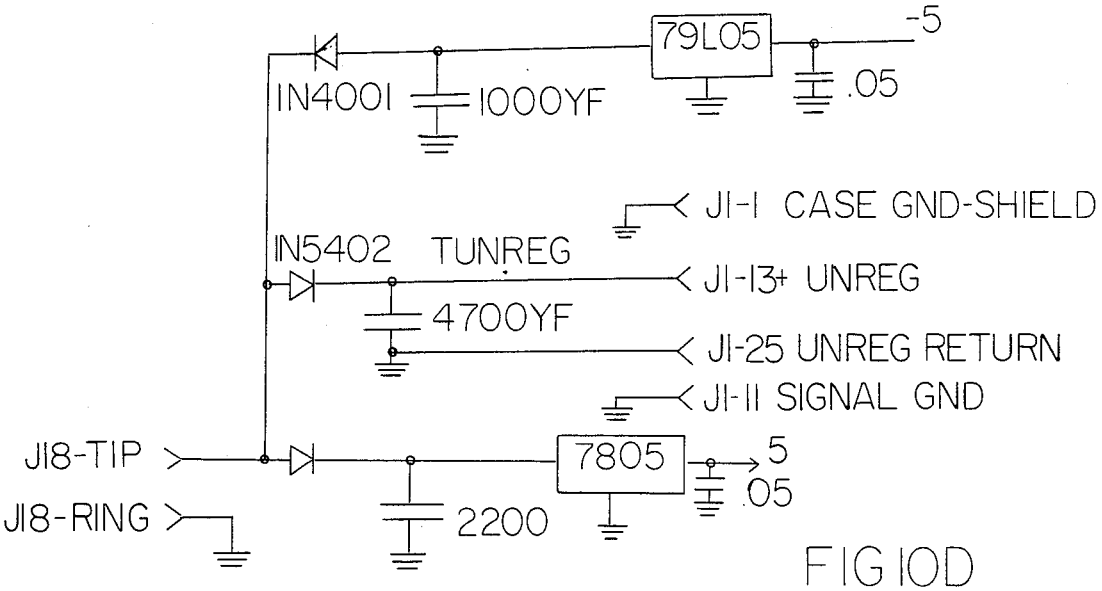

Attention is now directed to FIG. 8 for a view of the pendulum mechanism that attempts to return the top portion 37 of the auxiliary housing to the normal position of FIG. 8. Note that the bottom 38 of the auxiliary housing 19 has an opening 43. The top portion 37 is hinged to the bottom 38 at 40. A side wall 45 of the top portion 37 has affixed to it internally one end of a bracket 46. The other end of the bracket has a counterweight 47 attached to it. The weight 47 is designed to return the weight to the position shown in FIG. 8.

Figure 11A:
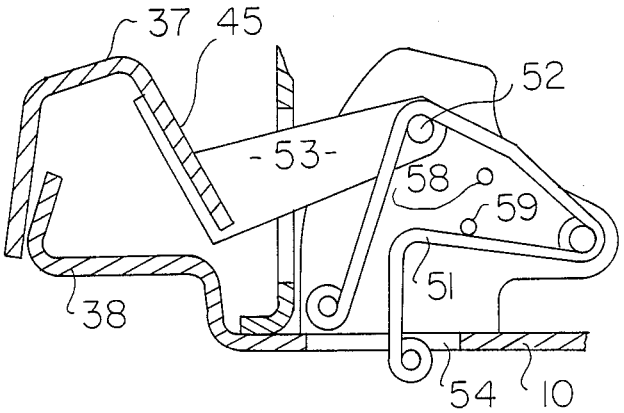
FIGS. 11A, 11B and 11C is a partial cross-sectional view of the mechanism for auxiliary housing.
Figure 11B:
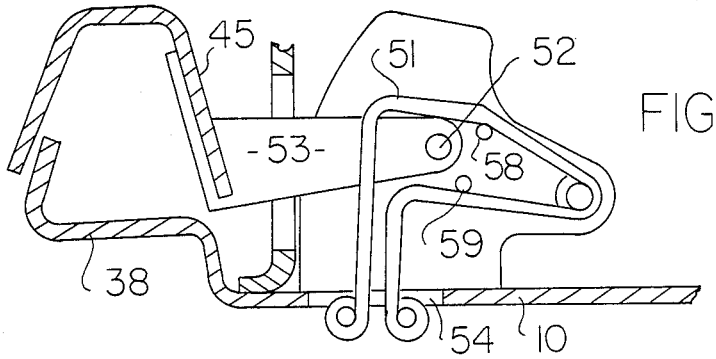
Figure 11C:
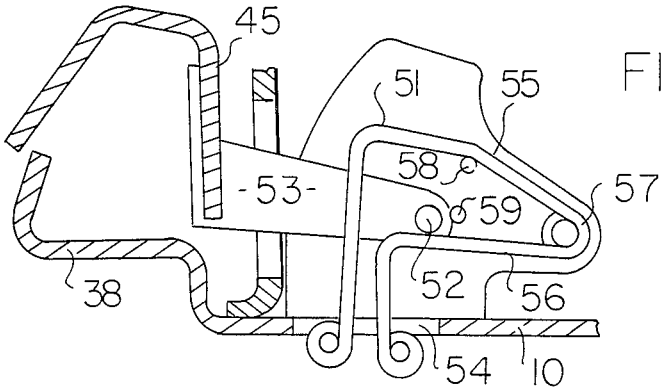

A spring mechanism is provided as shown in FIGS. 11A, 11B and 11C to just counter balance the weight 47 of FIG. 8. Said mechanism is spring loaded and is adjustable to keep the top portion of the auxiliary housing in a selected position. For instance, if the top 37 is moved counterclockwise as shown in FIG. 11A, spring 51 impinges on the end part 52 of arm 53 having the other end affixed to side 45 of the top portion 37. The spring 51 is affixed through opening 54 of the bottom 10. A spring 51 has two extended wings 55 and 56 and a coil 57. Parts 58 and 59 provide for stability and are perpendicularly secured to upstanding member 60 secured to the flat bottom 10.

Figure 12:
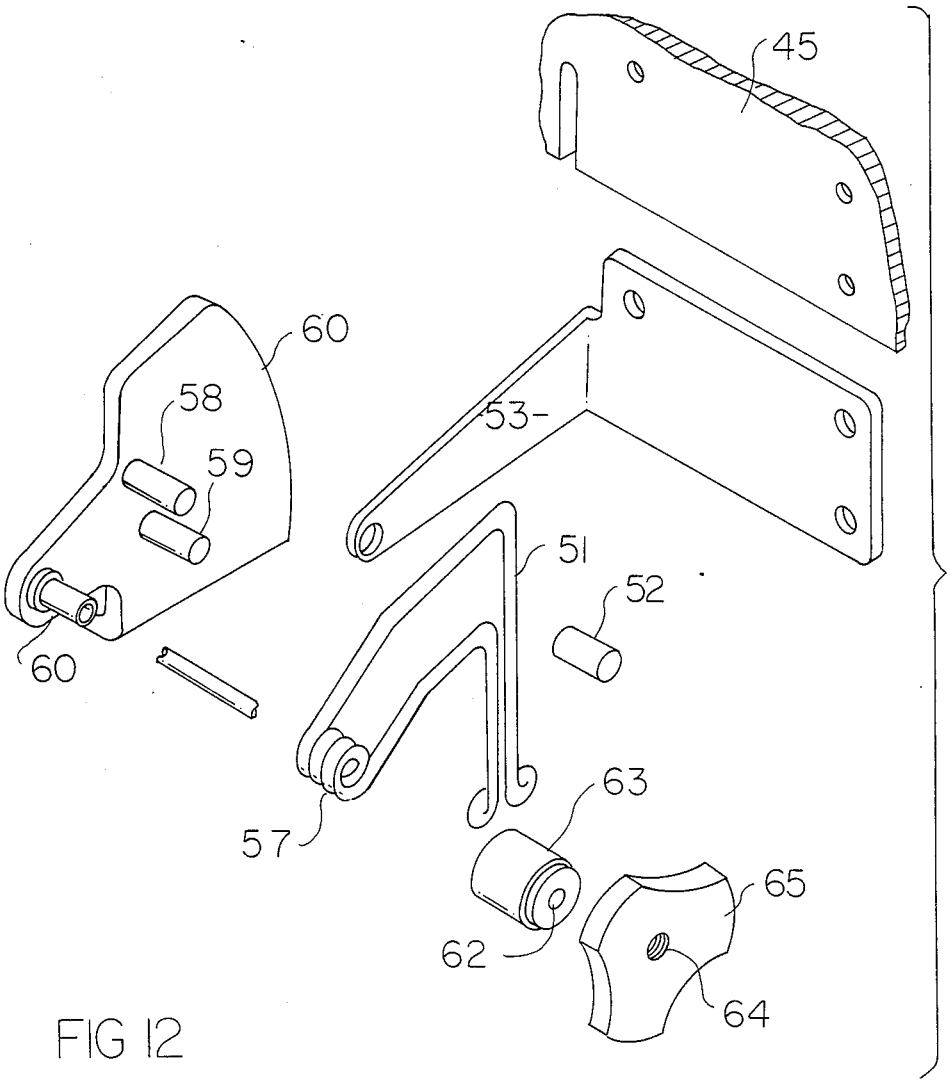
FIG. 12 is an exploded view of the tensioning control mechanism to control the pivoting of the auxiliary housing.

Tension control means can be seen from FIG. 12 which is an exploded view of such mechanism. Note that the coil portion 57 of the spring is mounted on cylindrical spindle 60 on frame 60A. A threaded rod 61 is fixedly inserted into the spindle 60 thereinto and extends through the coil 57 a bore 62 of pressure applying plug 63 and into threaded bore 64 of manual handle 65 for tightening and loosening of the spring 51.

It is pointed out that the assembly of the hardware and software in the present device has a uniqueness all its own. As mentioned in the foregoing the present device expressively controls music synthesizer parameters which comprise of up to four modules consisting of movable bars. The bar 17 mentioned as having the ability to move form side to side and arcuately may have two modes of operation. It may have a center spring return similar to the movement of most pitch wheels. By releasing the spring tension, a smooth continuous forward and back motion becomes available. This can be adapted and constructed to remain in position when released thus allowing the bar 17 to be employed as a volume or "swell" bar to hold specific intervals of pitch change.

The switch panel below bar 16C shown in FIG. 1 contains a array of conventional tactile switches 70 and a 2-line backlit conventional LCD 71 of FIGS. 1, 9A–9B, and 10A–10E that conveys information relative to the bar 17 function, for instances and a number of other switches 72 more about which will be imparted below. The arrangement is characterized as follows:

| | | |
|---|---|---|
| 0 1 2 3 4 5 6 7 8 9 | -LCD- X X2<br>− +<br>− + | ( )MODE PANIC<br>STORE |

The LCD display is a 2-line by 24-character backlit display which is readable in any lighting situation form total darkness to direct sunlight. The LCD display 71 shows numeric and descriptive information as well as graphic representations of waveforms and response curves. The performance bar 17 operates in two different modes: i.e., performance mode and edit mode. The mode is selected by pressing the "MODE SELECT" switch. The so-selected mode is then indicated by the LCD display.

PERFORMANCE MODE

1. In performance mode, the numeric (0 through 9) keys are used to select memories (presets) 0 through 9.
2. The X1 and X2 keys are used to set flags in memory. These can be used to activate footswitch actuated effects and/or send messages over the MIDI bas.
3. The (and) key will scroll through additional memory banks if the extended memory option is included.
4. The MODE select switch will toggle the bar between Performance and Edit mode.
5. The PANIC button will send the typical MIDI all-notes-off commands to all MIDI devices as well as individual note-off command, pitch wheel re-centering, mode wheel reset, and the like.

EDIT MODE

1. In EDIT mode, the numeric (0 through 9) buttons are used for numeric entry of variables.
2. The + and − keys are used to increase incrementally or decrease incrementally variables.
3. The (and) keys are used to scroll the cursor to fields to be changed and/or examined.
4. The MODE select button will toggle the bar between EDIT and PERFORMANCE mode.
5. The STORE button is used in combination with the numeric pad to save new presets in performance memory.

SOFTWARE FEATURES

The PERFORMANCE BAR gathers data from a variety of input sources:

a. The positions of the individual performance bars.
b. Buttons X1 and X2 in performance mode.
c. Digital LFOs in the bar controller.
d. Incoming MIDI messages.

From these sources, it can control a number of output devices:

a. up to 4 opto-isolated volume control channels for analog devices with selectable audio or linear tape response.
b. Two footswitch outputs (on/off relay).
c. Outgoing, MIDI messages.

Up to 8 types of outgoing MIDI messages can be generated by the bar at one time. The messages can be directed to any MIDI channel number and can address any of the MIDI continuous controllers.

Incoming MIDI messages can be filtered and parsed, and extracted numbers used to control audio sources, relay outputs, and generation of outgoing MIDI messages.

Bar movement can be used to generate outgoing MIDI messages, actuate relay outputs, or control the volume of the audio sources.

Digital LFOs can be used to control volumes, panning, or tremolo of audio sources, to generate outgoing MIDI data streams, or to switch the relay outputs on and off.

Buttons X1 and X2 can be used to turn audio sources on and off, to actuate relay outputs, or to generate outgoing MIDI data streams.

EDIT MODE OPERATION

Editing is accomplished by putting the bar in EDIT mode then selecting the job to be worked on. Such function of the bar is represented by a job number. Each job is responsible for one action of the bar. Within each job, there are features which can be turned on and off, and variables which can be changed. To change something, one simply scrolls the cursor to the item to be changed, and either use the + or − keys to change the value, or enter a new number using the numeric keys. To address a different job, simply scroll to the job number, and use the + and − keys to scan through the various jobs, or enter a job number directly with the numeric pad. Jobs include:

Position inputs form the bar.
Reading switches X1 and X2
Parsing incoming MIDI messages
MIDI through and filter functions
Control of audio channels
Control of footswitch relays
Generation of outgoing MIDI messages
Special effects (arpeggiation, etc.)

New jobs will be written to add new functions to the bar, and synthesizer-specific jobs will be used to provide special control over synthesizers via system-exclusive or other messages.

The controller board contains an option socket which can be used to extend the software routines, or to add more memories to the computer.

Each LFO has adjustable rate from 0 to 127, and has 16 outputs available simultaneously in memory. The waveform include:

0 (4) sine waves, each 90° out of phase.
0 (4) triangular waves each 90° out of phase.
0 (4) square waves, each 90° out of phase.
0 ramp up and ramp down
0 random
0 Leslie horn pulse waveform (highly non-symmetrical sine wave)
0 a fixed rate LFO is also available.

The position of each bar is used to create 8 different response curves in memory, which are all available for use at the same time. LFO settings can be copied from one to the other. Values may be manipulated within the bar.

The following math functions are available: multiplier, scaler, adder, subtractor, inverter, limiter, and threshold detector.

The abundant use of graphics and "windowing" assures user-friendly operation.

The on-board memory chips are powered by a lithium cell for battery backup, and are designed to retain data while power is off.

Private punch-in user code prevents the unauthorized use of the bar.

What is claimed is:

1. A variable control device accessory for a music synthesizer having a horizontally disposed keyboard, the variable control device being positionable in front of a keyboard of a music synthesizer comprising:

an elongated bar dimensioned approximately the width of a keyboard of a music synthesizer when in place being disposed at a plane approximately parallel therewith whereby at least one wrist of a player may rest on the elongated bar while the player fingers the keyboard in order to play the music synthesizer, said bar being mounted on a frame which is mountable with respect to said music synthesizer and is adapted and constructed to be displaceable in pivotable movement and in horizontal slidable movement parallel to the front of the keyboard in response to the wrist action of the player said bar having means for providing variable electric current to said music synthesizer in proportion to the pivotable displacement position of said bar whereby a selected parameter of the synthesizer is controllable, said bar having means for providing variable electric current to said music synthesizer in proportion to the horizontal slidable movement of the bar whereby a selected parameter of the synthesizer is controllable, means for arcuately returning said bar to a preselected normal position when said bar is released from a pivoted position, at least one non-pivoting bar being positioned substantially parallel to said pivotable bar adapted and constructed to be slidable from side to side across the front of the keyboard by the wrist of a player, said non-pivotable bar having means for providing variable electric current to said music synthesizer in proportion to the degree of sliding movement of said non-pivoting bar whereby a selected parameter of the synthesizer is controlled, means for displaying positioning information for the pivotable bar and for the non-pivotable bar.

2. The variable control device accessory of claim 1 wherein the means for providing electric current to said music synthesizer in proportion to the pivotable displacement position of said bar includes an electric lamp, a photocell in spaced relationship with regard to said electric lamp and in light receiving path of said electric lamp, a mask interposed therebetween, and said pivotable bar and said mask adapted and constructed to vary the light from said electric lamp capable of falling on said photocell as said bar is moved from side to side thereby providing variable electric output.

3. The variable control device accessory of claim 1 wherein the means for providing electric current to said music synthesizer in proportion to the horizontal slidable movement of the bar includes an electric lamp, a photocell in spaced relationship with regard to said electric lamp and in light receiving path therewith, a mask interposed in said path and said mask being adapted and constructed to vary the width of light capable of falling on said photocell as the pivotable bar is pivoted providing a variable electric output.

4. The variable control device accessory of claim 3 wherein the means for providing variable electric current to said music synthesizer in proportion to the degree of sliding movement of said non-pivoting bar includes an electric lamp fixed to said non-pivotable bar, a photocell fixed to said non-pivotable bar in spaced relationship with regard to said electric lamp and in light receiving path, from said electric lamp, a mask disposed in said path and said mask being fixed and adapted and constructed to vary the width of light capable of falling on said photocell fixed to said non-pivotable bar as the non-pivotable bar is slide thereby providing a variable electric output.

* * * * *